US006415778B1

(12) United States Patent
Makino et al.

(10) Patent No.: US 6,415,778 B1
(45) Date of Patent: Jul. 9, 2002

(54) BREATHER CHAMBER STRUCTURE OF INTERNAL COMBUSTION ENGINE

(75) Inventors: Hiroyuki Makino; Masaharu Goto; Yasuyo Kosugi; Shotaro Takano, all of Wako (JP)

(73) Assignee: Hnoda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/807,957

(22) PCT Filed: Sep. 1, 2000

(86) PCT No.: PCT/JP00/05948

§ 371 (c)(1),
(2), (4) Date: Jul. 19, 2001

(87) PCT Pub. No.: WO01/18364

PCT Pub. Date: Mar. 15, 2001

(30) Foreign Application Priority Data

Sep. 3, 1999 (JP) ..... 11-250778

(51) Int. Cl.[7] ..... F02M 35/10; F01M 13/04
(52) U.S. Cl. ..... 123/572
(58) Field of Search ..... 123/572, 573, 123/574, 41.84

(56) References Cited

U.S. PATENT DOCUMENTS 4,541,399 A * 9/1985 Tanaka et al. ..... 123/573
4,632,071 A * 12/1986 Arai et al. ..... 123/41.86

FOREIGN PATENT DOCUMENTS

JP 4-342864 11/1992

* cited by examiner

*Primary Examiner*—Marguerite McMahon
(74) *Attorney, Agent, or Firm*—Arent Fox Kintner Plotkin & Kahn, PLLC

(57) ABSTRACT

A breather chamber structure of an internal combustion engine in which condensation of vapor within the breather chamber is prevented, the number of required parts is small, the space efficiency is superior and enlargement of the whole engine can be avoided is provided.

In an internal combustion engine having auxiliary machinery attached to a side wall of a cylinder block (3) by means of an auxiliary machinery bracket (10), a breather chamber (20) is formed by the side wall of the cylinder block (3) and the auxiliary machinery bracket (10) between the side wall and the bracket, and a cooling water passage (40), (41) is formed on at least one of the side wall of the cylinder block (3) and the auxiliary machinery bracket (10) swelling in the breather chamber (20).

5 Claims, 9 Drawing Sheets

BREATHER CHAMBER STRUCTURE OF INTERNAL COMBUSTION ENGINE

TECHNICAL FIELD

The present invention relates to a breather chamber structure of an internal combustion engine.

BACKGROUND ART

An internal combustion engine has a blow-by gas return apparatus for returning blow-by gas leaking in a crank chamber at a compression stroke to a suction system to prevent the blow-gas from being discharged to the atmosphere. The blow-by gas return apparatus includes a breather chamber for separating gas and liquid each other. Oil separated in the breather chamber is taken out and the blow-by gas including remaining not separated oil is sent to the suction system to be burned again.

A breather chamber disposed on a side wall of a cylinder block is disclosed in Japanese Laid-Open Patent Publication Hei 4-342864.

This breather chamber is provided on the cylinder block side wall utilizing a relatively large space formedbetween the cylinder block and a surge tank.

When the engine runs normally, the breather chamber is warmed by heat of the cylinder block so that interior of the breather chamber is not dewed, but in course of warming-up immediately after starting of the engine, especially in the cold season, the breather chamber is not warmed soon so that vapor in the blow-by gas condenses within the breather chamber and it is feared that the condensed water is mixed in the separated oil to be recovered.

The water mixed in the oil hasten deterioration of oil and causes generation of sludge varnish.

In the above-mentioned publication, the breather chamber is formed by covering a breather hollow on the cylinder block side wall with a lid plate, or the breather chamber is formed integrally with the cylinder block side wall, or a side wall of the surge tank is used as the lid plate. However, the breather chamber formed by covering with the lid plate requires many parts, the breather chamber formed integrally with the cylinder block side wall is complicated in working and forming, and the breather chamber using the side wall of the surge tank as the lid plate is troublesome in assembling work and injures universality of the surge tank.

DISCLOSURE OF INVENTION

The present invention has been accomplished in view of the foregoing, and an object of the invention is to provide a breather chamber structure of an internal combustion engine in which condensation of vapor within the breather chamber is prevented, the number of required parts is small, the space efficiency is superior and enlargement of the whole engine can be avoided.

In order to achieve the above object, the present invention provides a breather chamber structure of an internal combustion engine having auxiliary machinery attached to a side wall of a cylinder block by means of an auxiliary machinery bracket, comprising a breather chamber formed by the side wall of the cylinder block and the auxiliary machinery bracket between the side wall and the bracket, and a cooling water passage formed on at least one of the side wall of the cylinder block and the auxiliary machinery bracket swelling in the breather chamber.

On warming-up immediately after starting of the engine when temperature of the breather chamber is very low, the breather chamber can be warmed easily by circulating cooling water through the cooling water passage to prevent condensation of vapor in the breather chamber and it can be avoided that water is mixed in recovered oil.

When the engine is in warming-up operation, the breather chamber can be warmed quickly by letting cooling water warmed by the engine flow through the cooling water passage swelling in the breather chamber and condensation of vapor in the breather chamber can be prevented easily.

Since the breather chamber is formed between the auxiliary machinery bracket and the cylinder block side wall utilizing the auxiliary machinery bracket, and the cooling water passage is provided in the breather chamber, a space between the cylinder block and the auxiliary machinery is utilized to improve space efficiency, enlarging of the whole engine can be avoided, the number of parts can be reduced and the assembling work can be facilitated.

According to the invention. In the breather chamber structure of an internal combustion engine having auxiliary machinery attached to a side wall of a cylinder block by means of an auxiliary machinery bracket, a breather chamber formed by the side wall of the cylinder block and the auxiliary machinery bracket between the side wall and the bracket, and a cooling water passage formed on at least one of the side wall of the cylinder block and the auxiliary machinery bracket swelling in the breather chamber, the cooling water passage may be formed on the auxiliary machinery bracket, and a water pump may be attached to the auxiliary machinery bracket for circulating cooling water through the cooling water passage. Since the auxiliary machinery bracket constituting the breather chamber is utilized to attach the water pump, the cooling water passage can be formed in the breather chamber easily, the number of parts can be reduced and assembling can be carried out easily.

According to the invention, in the breather chamber structure having the cooling water passage formed on the auxiliary machinery bracket and the water pump attached to the auxiliary machinery bracket for circulating cooling water through the cooling water passage, a suction side cooling water passage connected to a suction side of the water pump and a discharge side cooling water passage connected to a discharge side of the water pump may be formed on a breather chamber portion of the auxiliary machinery bracket. Since both the suction side cooling water passage and the discharge side cooling water passage are formed in the breather chamber, the breather chamber can be warmed efficiently to prevent condensation of vapor when the engine is started.

In the breather chamber structure, a blow-by gas passage connecting an interior of a crankcase with the breather chamber may be formed in the side wall of the cylinder block, and an oil recovery passage for recovering oil separated from the blow-by gas in the breather chamber into an oil pan may be formed in a lower part of the side wall of the cylinder block. Since both the blow-by gas passage and the oil recovering passage are formed in the side wall of the cylinder block, it is unnecessary that such passages communicating with the interior of the crankcase and the interior of the oil pan are formed in the auxiliary machinery bracket to bring out a complicated construction and an attachment for sealing. Therefore, the construction can be simplified and the cost can be lowered.

In the breather chamber structure, the auxiliary machinery bracket may be a synthetic bracket for attaching more than two auxiliary machines. A plurality of auxiliary machines can be attached intensively with a few parts, enlarging of the whole engine can be prevented, the assembling work is easy and the cost can be reduced.

BEST MODE FOR CARRYING OUT THE INVENTION

Hereinafter, a preferred embodiment of the present invention will be described with reference to FIGS. 1 to 9.

Figure 1:
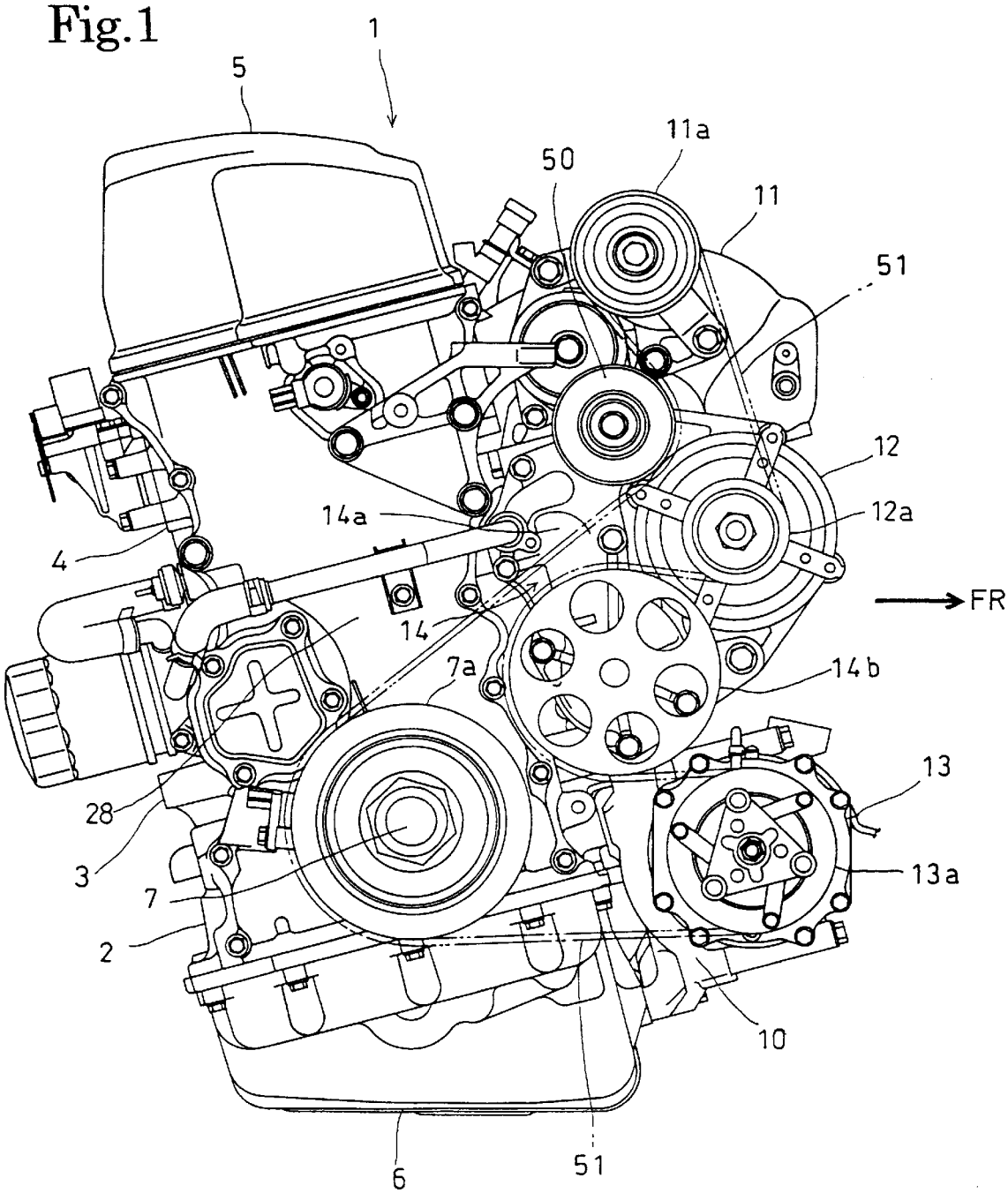
FIG. 1 is a whole view of an internal combustion engine according to an embodiment of the present invention.
Figure 2:
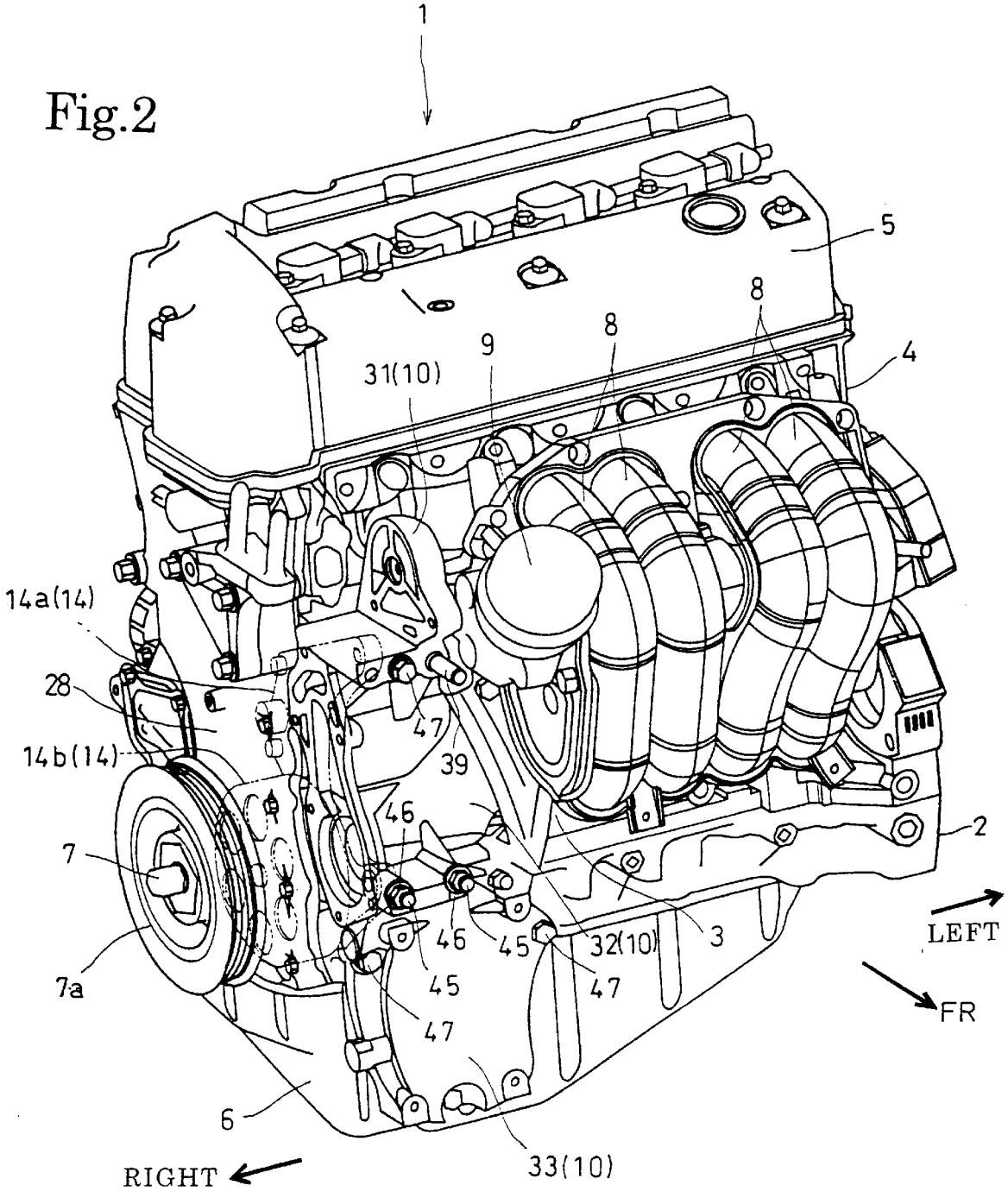
FIG. 2 is a whole perspective view of the engine with an auxiliary machinery bracket from which auxiliary machinery is remover.
Figure 3:
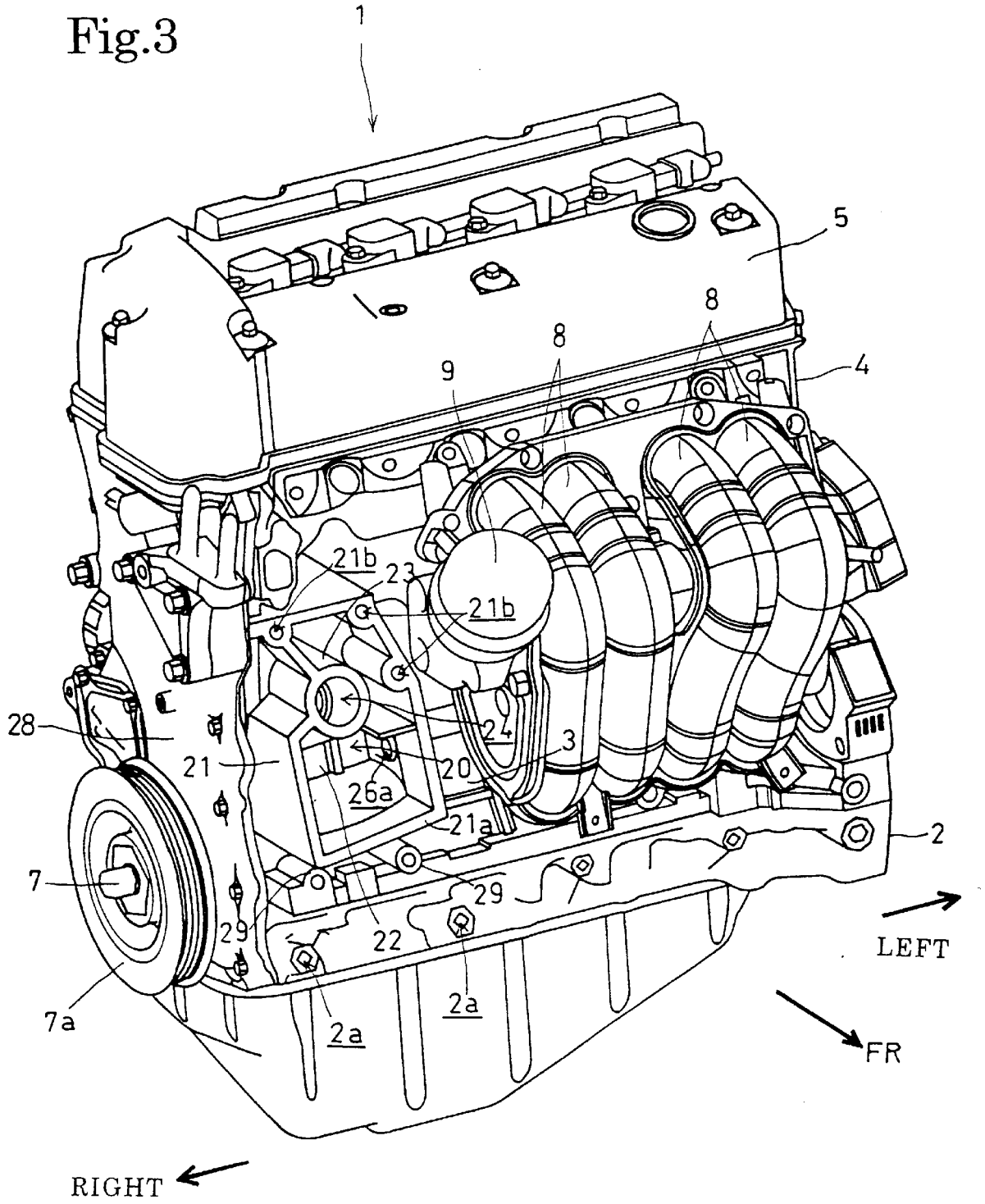
FIG. 3 is a whole perspective view of the engine from which both the auxiliary machinery and the auxiliary machinery bracket are removed.

An internal combustion engine 1 according to this embodiment is a water-cooled 4-cycle 4-cylinder straight-type internal combustion engine as shown in FIGS. 1 to 3. The engine 1 is mounted on a vehicle with a crankshaft 7 directed in right-left direction.

A cylinder block 3, a cylinder head 4 and a cylinder head cover 5 are piled in order on a crankcase 2 and tightened together. An oil pan is connected to a lower face of the crankcase 2.

Four suction pipes 8 corresponding to respective cylinders project from a front face of the cylinder head 4 forward gathering to the left (right in FIGS. 2 to 4) and extend bending downward.

Positioned on the right side of the suction pipes 8 is disposed a pipe length changing control valve 9 for adjusting length of the suction pipes 8. In a space at the right side of the control valve 9 are attached auxiliary machines such as an oil pressure pump 11, an AC generator 12, a compressor 13 and a water pump 14 by means of an auxiliary machinery bracket.

Figure 4:
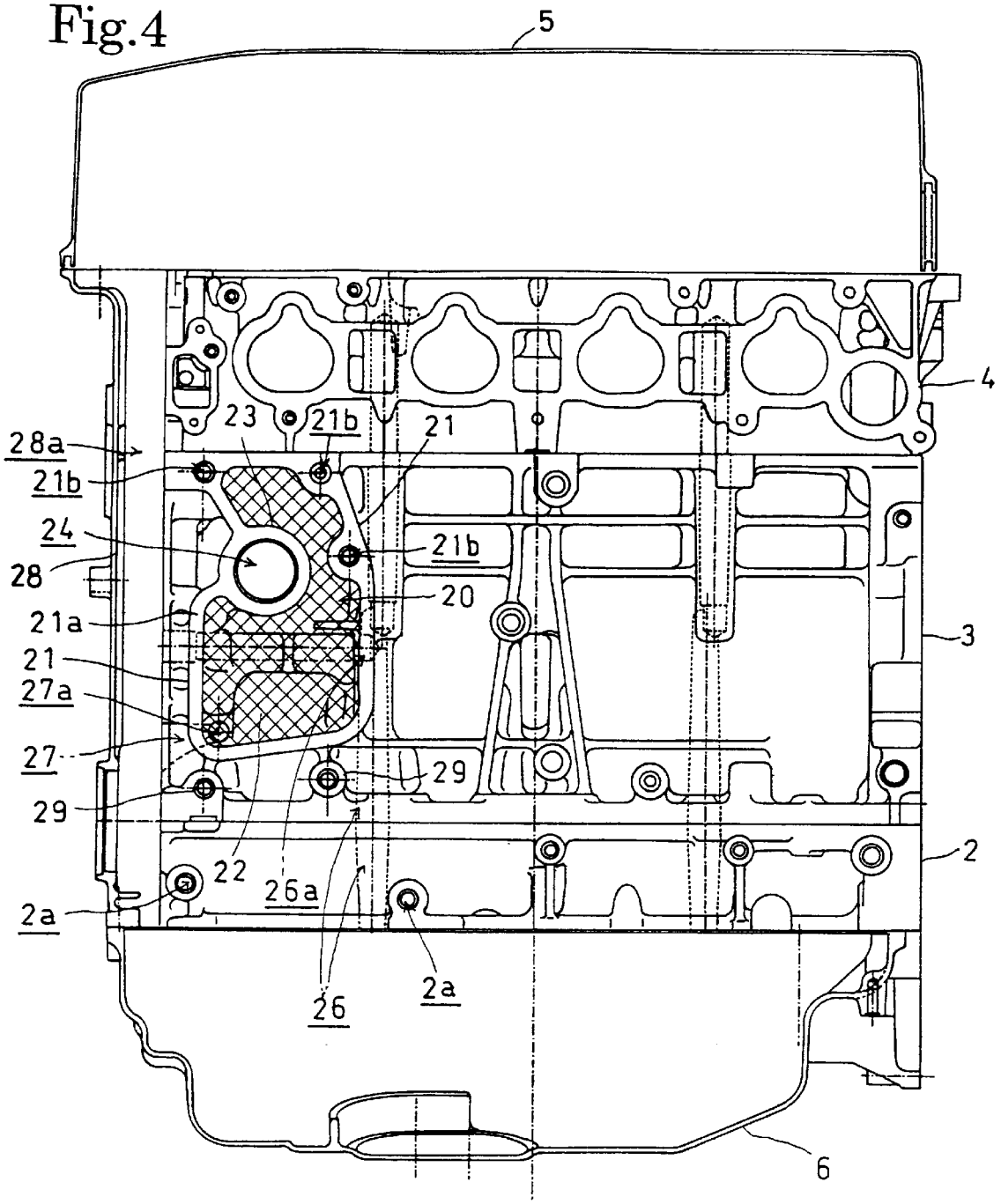
FIG. 4 is a front view of a main body block of the engine.

As shown in FIGS. 3 and 4, on a right side portion of a front wall of the cylinder block 3 is formed a projecting rectangular enclosing wall 21 having a bottom wall 22. This enclosing wall 21 forms a half part of a breather chamber 20.

An end of the enclosing wall forms a flat contact face 21*a* having three bolt holes 21*b*.

A right portion of the enclosing wall 21 is bent inside and there is formed a cylindrical wall 23 constituting a cooling water passage. The discharging side cooling water passage 24 within the cylindrical wall 23 penetrates the wall of the cylinder block 3 to communicate with a water jacket 25 formed around a cylinder bore (see FIG. 9).

A portion having the bottom wall 22 surrounded by the enclosing wall 21 and the cylindrical wall 23 (a portion shown by cross hatches in FIG. 4) form the breather chamber 20.

In a left lower portion of the enclosing wall 21 is provided a blow-by gas introducing port 26*a* communicating with the breather chamber 20.

The blow-by gas introducing port 26*a* is an opening at a downstream end of a blow-gas introducing passage 26 which penetrates walls of the cylinder block 3 and the crankcase 2 vertically to communicate with the crankcase 2 (FIG. 4).

As shown in FIG. 4, at a right (left in FIG. 2) lower corner portion of the bottom wall 22 is provided an oil recovery port 27*a,* and a oil recovery passage 27 extends from the oil recovery port 27*a* toward the right (left in FIG. 2) widening downward. The oil recovery passage 27 communicates with a cam chain chamber 28*a* covered with a chain case 28 provided on a right side portion (left side in FIG. 2) of the internal combustion engine 1.

A lower side of the enclosing wall 27 is inclined so as to descend toward the right, therefore the oil recovery port 27*a* is positioned at the lowest point of the breather chamber 20. The oil recovery port 27*a* communicates with the cam chain chamber 28*a* through the oil recovery passage 27 widening downward, and the cam chain chamber 28*a* communicates with the oil pan 6 positioned below.

On the wall of the cylinder block 3 under the breather chamber 20 are projected a pair of right and left attachment bosses 29, and under the bosses 29 are formed right and left bolt holes 2*a* on the crankcase An auxiliary machinery bracket 10 is attached to the walls of the cylinder block 3 and the crankcase 2 elongating up and down. This auxiliary machinery bracket 10 is a synthetic bracket for supporting a plurality of auxiliary machines by a single bracket.

FIGS. 5 to 9 show the auxiliary machinery bracket 10.

Figure 5:
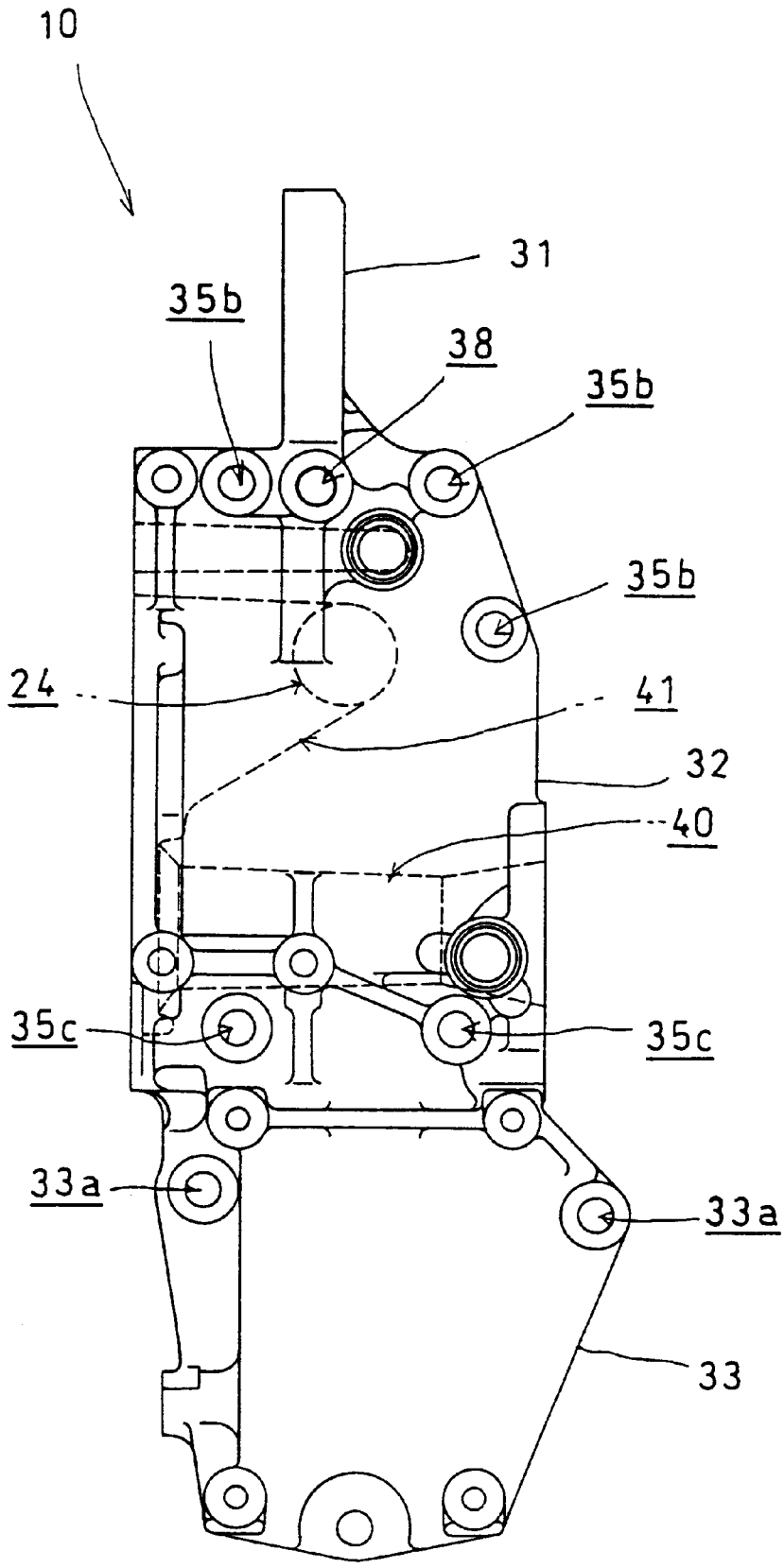
FIG. 5 is a front view of the auxiliary machinery bracket.

The auxiliary machinery bracket 10 is formed so as to be long vertically and can be sectioned into upper, middle and lower portions roughly. The upper portion is a flat plate 31 perpendicular to right-left direction having an arcuate upper edge. The middle and lower portions form walls 32, 33 perpendicular to front-rear direction. The middle wall 32 and the lower wall 33 jointly present a front view of a vertically long rectangular (FIG. 5).

On the right side of the upper flat plate 31 is attached an oil pressure pump 11 for power steering, on a front face of the middle wall 32 is attached an AC generator 12 and on a curved front face of the lower wall 33 is attached a compressor 13.

A right end face of the middle wall 32 constitutes a contact face for attaching a water pump 14.

Figure 6:
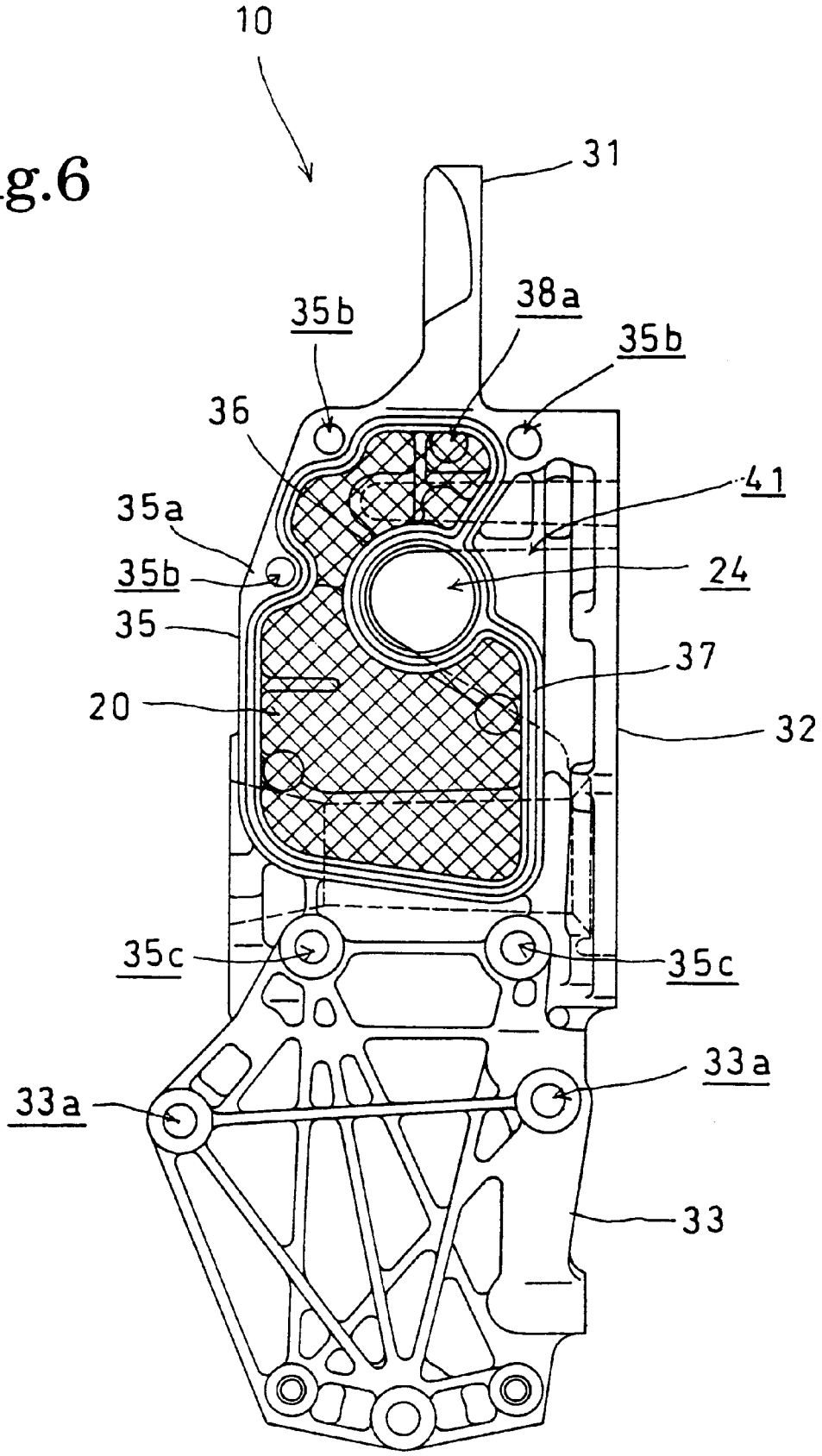
FIG. 6 is a rear view thereof.
Figure 7:
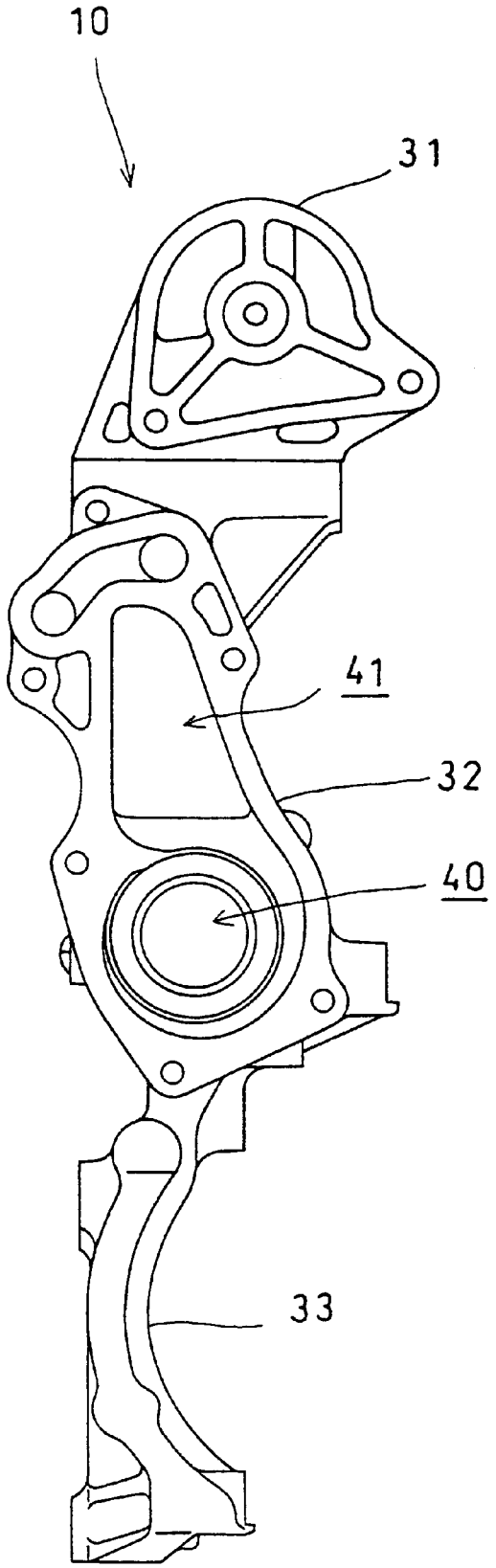
FIG. 7 is a right side view thereof.
Figure 8:
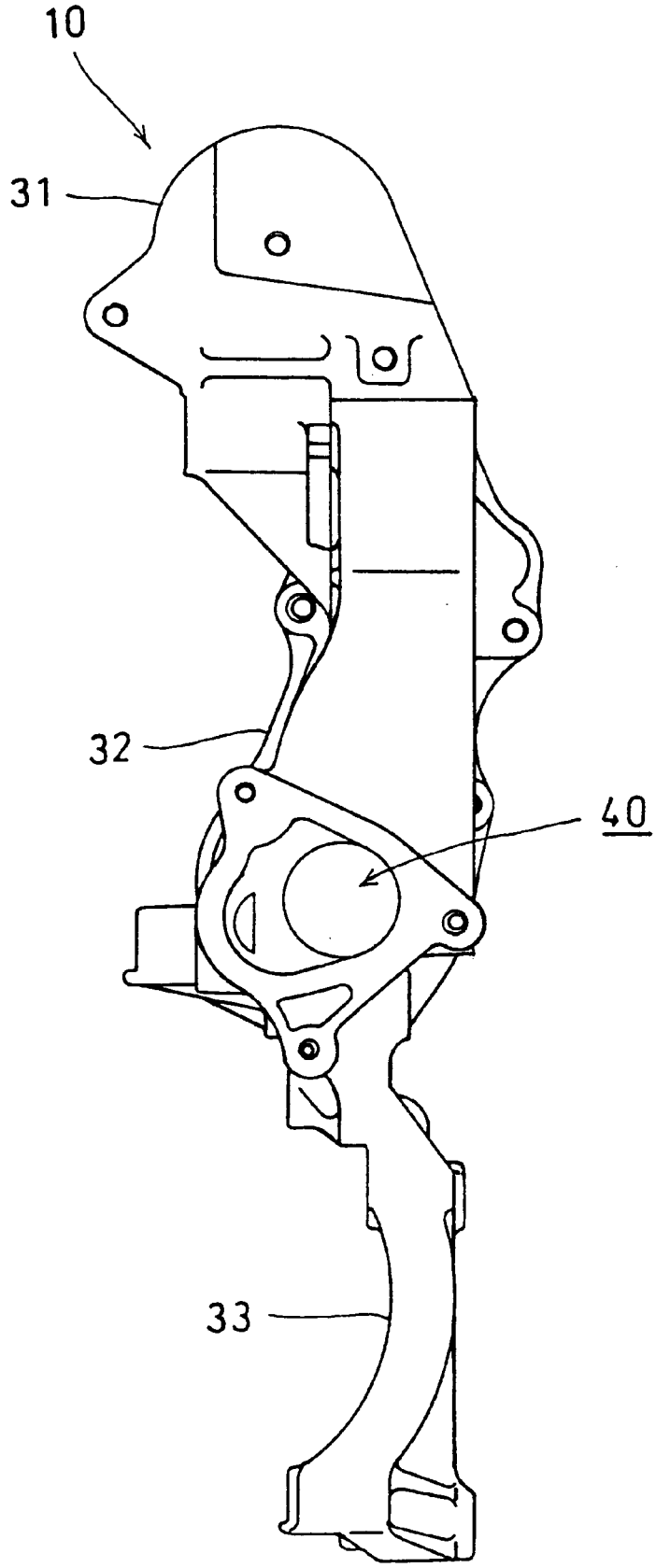
FIG. 8 is a left side view thereof.

On a rear face of the middle wall 32 are projected an enclosing wall 35 and a cylindrical wall 36 corresponding to the enclosing wall 21 and the cylindrical wall 23 on the front wall of the cylinder block 3 (FIG. 6). End faces of the walls 35, 36 constitutes a contact face 35*a* to be connected with the enclosing wall 21 and the cylindrical wall 23 of the cylinder block 3 through a packing 37.

In FIG. 6, a portion surrounded by the enclosing wall 35 and the cylindrical wall 36 (a portion shown by cross hatches) constitutes the breather chamber 20, and the interior of the cylindrical wall 36 constitutes the discharge side cooling water passage 24 together with the interior of the cylindrical wall 23 on the side of the cylinder block 3.

On an upper part of the contact face 35*a* of the enclosing wall 35 are drilled three attachment holes 35*b,* on a lower part of the contact face 35*a* are drilled right and left attachment holes 35*c,* and on the lower wall 33 are drilled right and left attachment holes 33*a* at positions somewhat higher than the middle.

Figure 9:
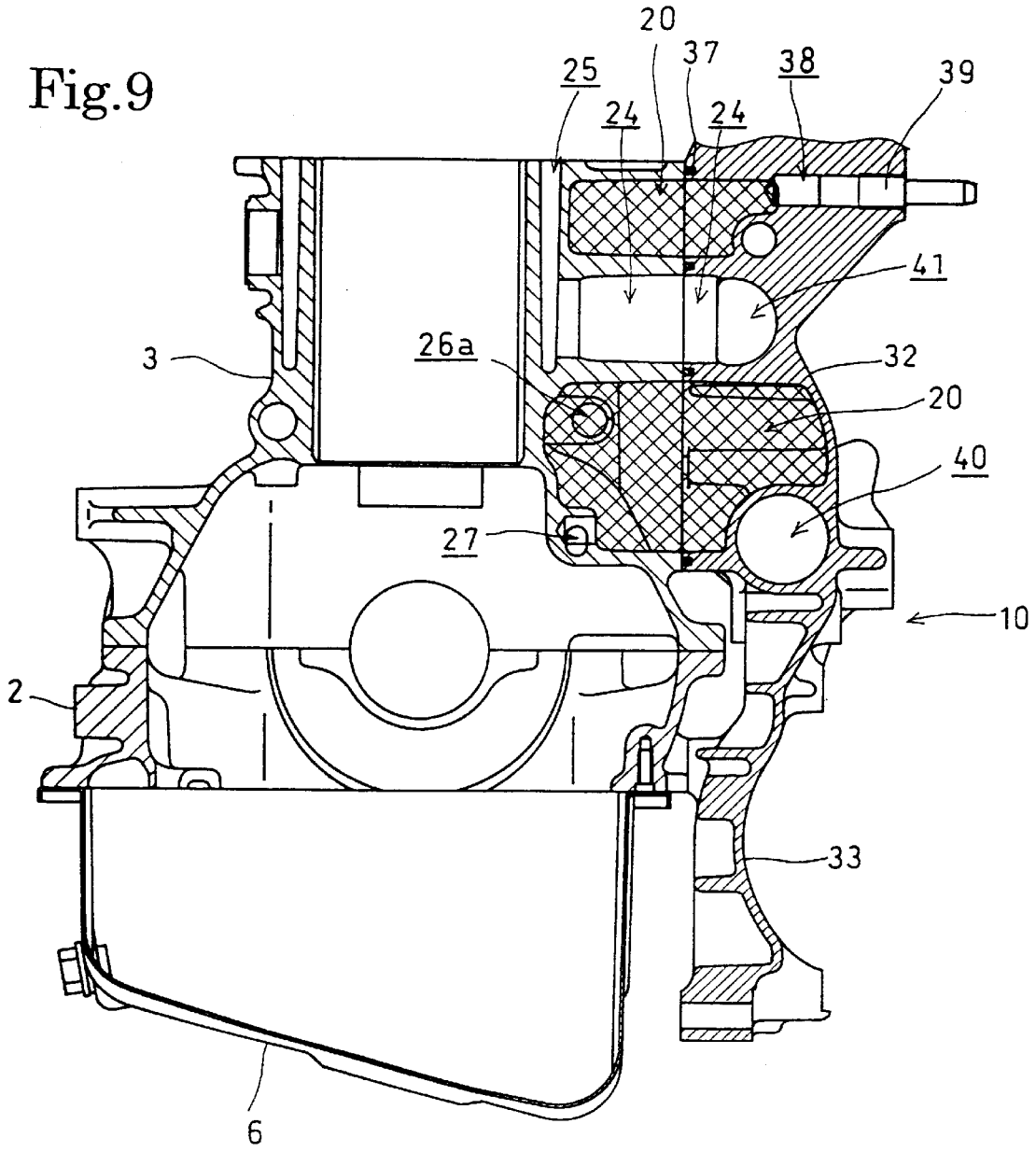
FIG. 9 is a sectional view showing the auxiliary machinery bracket attached to the engine main body.

At an upper part of the middle wall 32 along a lower surface of the enclosing wall 35 is formed a gas outlet port 38*a* opening to the breather chamber 20, a gas outlet hole 38 communicating with the gas outlet port 38*a* extends forward penetrating the middle wall 32, a PCV valve 39 is fitted in the gas outlet hole 38 (FIG. 9).

A circular suction side cooling water passage 40 penetrates a lower part of the middle wall 32 in right-left direction horizontally. Above the suction side cooling water passage 40, a discharge side cooling water passage 41 is drilled from the right end face of the wall 32 to communicate with the discharge side cooling water passage 24 in the cylindrical wall 36.

While the suction side cooling water passage 40 is a circular hole extending in right-left direction, the discharge side cooling water passage 41 has a right end opening elongated vertically and the sectional area of the passage 41 becomes gradually smaller toward the cylindrical wall 36 where the passage 41 is connected with the passage 24.

To the contact face on the right side of the middle wall 32 is joined a pump case 14a of the water pump 14 (see dot-dash line in FIG. 2).

A driven pulley 14*b* is projected from the pump case 14*a*.

Referring to FIG. 3, in the bolt holes 29 provided on the right side part of the front wall of the cylinder block 3 are screwed stud bolts 45 before the auxiliary machinery bracket 10 is attached, then the auxiliary machinery bracket 10 is piled up with the attachment holes 35*c* thereof penetrated by the stud bolts 45. Thus, the contact faces of the enclosing walls 21, 35 and the contact faces of the cylindrical walls 23, 36 are piled up through the packing 37, respectively.

Then nuts 46 are screwed onto respective exposed ends of the stud bolts 46, and the upper three positions (attachment holes 35*b,* bolt holes 21*b*) and lower two positions (attachment holes 33*a,* bolt holes 2*a*) are tightened by bolts 47.

FIG. 2 shows the engine attached with the auxiliary machinery bracket 10 in the manner as mentioned above. On the right end face of the auxiliary machinery bracket 10 is attached the water pump 14 as shown by the dot-dash line.

Then, the oil pressure pump 11 is attached to the upper flat plate 31, the AC generator 12 is attached to the front face of the middle wall 32 and the compressor 13 is attached to the front face of the curved lower wall 33, as shown in FIG. 1.

An endless belt 51 is wound round a drive pulley 7*a* fitted to the crankshaft, an idler pulley 50, a driven pulley 11*a* of the oil pressure pump 11, a driven pulley 12*a* of the AC generator 12, a driven pulley 14*b* of the water pump 14 and a driven pulley 13*a* of the compressor 13 so that the pulleys are driven altogether.

The breather chamber 20 formed by attaching the auxiliary machinery bracket 10 on the wall of the cylinder block 3 communicates with the interior of the crankcase 2 through the blow-by gas introducing passage 26 formed on side of the cylinder block 3, so that blow-by gas leaking in the crank chamber is introduced into the breather chamber 20 through the blow-by gas introducing passage 26 together with fresh air (FIG. 4).

FIG. 9 is a sectional view of the engine attached with the auxiliary machinery bracket 10 in which the part shown by cross hatches is the breather chamber 20.

In this breather chamber 20, blow-by gas is separated into vapor and liquid, and separated oil component flows out into the cam chain chamber 28*a* through the oil recovery passage 27 opening at the lowest point of the breather chamber 20 to be recovered within the oil pan 6.

On the one hand, the blow-by gas from which the oil component has been separated is guided from the gas outlet hole 38 to an outlet pipe (not shown) with a flow rate adjusted by the PCV valve 38, and sent to a suction chamber at downstream side of a throttle valve to be burned again.

Since both the blow-by gas introducing passage 26 connecting the breather chamber 20 to the interior of the crankcase 2 and the oil recovery passage 27 connecting the breather chamber 20 to the interior of the oil pan 6 are formed in the wall of the cylinder block 3, it is possible to simplify the construction and reduce the cost. If the above-mentioned passages are formed in the auxiliary machinery bracket 10, the construction to connect the passages to the crankcase and the oil pan is complicated and a special attachment is necessary for sealing.

The left side opening of the suction side cooling water passage 40 is connected with a cooling water circulation passage so as to communicating with a passage communicating with the radiator or a return passage from the engine by switching over a thermostat valve, Cooling water is introduced to the suction side cooling water passage 40 by the water pump 14.

The cooling water sucked in the water pump 14 from the right end opening of the suction side cooling water passage 40 is discharged to the right end opening of the discharge side cooling water passage 41 and introduced into the water jacket 25 of the of the cylinder block 3 through the discharge side cooling water passage 41 and the discharge side cooling water passage 24 (FIG. 9).

During warming-up immediately after starting of the engine, the aforementioned thermostat valve opens a bypass passage so that cooling water heated by the engine is sent directly to the suction side cooling water passage 40 neighboring the breather chamber 20 Therefore, the breather chamber 20 can be warmed and condensation of vapor in the breather chamber 20 can be prevented.

Therefore, water is prevented from mixing in the recovered oil and deterioration of the oil can be avoided as far as possible.

Since the suction side cooling water passage 40 and the discharge side cooling water passages 41, 24 are formed swelling in the breather chamber 20, heating effect is high and the breather chamber 20 can be warmed efficiently and quickly.

On normal running of the engine, cooling water cooled by the radiator is sent to the suction side cooling water passage 40 and the discharge side cooling water passages 41, 24 to cool the breather chamber 20 for hastening vapor-liquid separation of blow-by gas.

Since the breather chamber 20 is formed between the cylinder block 3 and the auxiliary machinery bracket 10 utilizing the bracket 10 and the suction side cooling water passage 40 and the discharge side cooling water passages 41, 24 are formed integrally with the breather chamber 20, high space efficiency is obtained by utilizing a space between the cylinder block 3 and the auxiliary machinery, and enlargement of the whole internal combustion engine 1 can be avoided.

Since the water pump 14 is attached to the auxiliary machinery bracket 10 constituting the breather chamber 20, cooling water passages can be formed in the breather chamber easily, and it is possible to reduce the number of parts and facilitate the assembling.

The auxiliary machinery bracket 10 is a synthetic bracket which supports the oil pressure pump 11, the AC generator 12, the compressor 13 and the water pump 14 collectively, so that the auxiliary machines can be attached with a small number of attachment parts, enlargement of the whole international combustion engine can be prevented, the assembling work is easy and the cost can be reduced.

Industrial Applicability

The present invention can be applied to an internal combustion engine having auxiliary machinery attached to a side wall of a cylinder block by means of a reinforcement bracket.

What is claimed is:

1. A breather chamber structure of an internal combustion engine having auxilliary machinery attached to a side wall of a cylinder block by means of an auxiliary machinery bracket, comprising:

a breather chamber formed by said side wall of the cylinder block and said auxiliary machinery bracket between said side wall and said bracket; and a cooling water passage formed on at least one of said side wall of the cylinder block and said auxiliary machinery bracket swelling in said breather chamber.

2. A breather chamber structure of an internal combustion engine as claimed in claim 1, wherein said cooling water passage is formed on said auxiliary machinery bracket, and a water pumps attached to said auxiliary machinery bracket for circulating cooling water through said cooling water passage.

3. A breather chamber structure of an internal combustion engine as claimed in claim 2, wherein a suction side cooling water passage connected to a suction side of said water pump and a discharge side cooling water passage connected to a discharge side of said water pump are formed on a breather chamber portion of said auxiliary machinery bracket.

4. A breather chamber structure of an internal combustion engine as claimed in claim 1, 2 or 3, wherein a blow-by gas passage connecting an interior of a crankcase with said breather chamber is formed in said wall of the cylinder block, and an oil recovery passage for recovering oil separated from the blow-by gas in said breather chamber into an oil pan is formed in a lower part of said side wall of said cylinder block.

5. A breather chamber structure of an internal combustion engine as claimed in claim 1, wherein said auxiliary machinery bracket is a synthetic bracket for attaching more than two auxiliary machines.

* * * * *